US010315299B2

(12) United States Patent
Herr

(10) Patent No.: US 10,315,299 B2
(45) Date of Patent: Jun. 11, 2019

(54) HANDHELD TOOL DEVICE

(71) Applicant: Robert Bosch GmbH, Stuttgart (DE)

(72) Inventor: Tobias Herr, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 702 days.

(21) Appl. No.: 14/368,469

(22) PCT Filed: Dec. 19, 2012

(86) PCT No.: PCT/EP2012/076201
§ 371 (c)(1),
(2) Date: Jun. 24, 2014

(87) PCT Pub. No.: WO2013/098167
PCT Pub. Date: Jul. 4, 2013

(65) Prior Publication Data

US 2015/0075828 A1 Mar. 19, 2015

(30) Foreign Application Priority Data

Dec. 27, 2011 (DE) ..... 10 2011 089 910

(51) Int. Cl.

| | |
|---|---|
| ***B25B 21/02*** | (2006.01) |
| ***B25D 17/06*** | (2006.01) |
| ***B25D 11/08*** | (2006.01) |
| ***B25D 16/00*** | (2006.01) |

(52) U.S. Cl.
CPC ..... *B25D 17/06* (2013.01); *B25D 11/08* (2013.01); *B25D 16/00* (2013.01); *B25D 2211/006* (2013.01); *B25D 2217/0015* (2013.01); *B25D 2250/231* (2013.01); *B25D 2250/371* (2013.01)

(58) Field of Classification Search
CPC ..... B25B 21/02; B25B 21/026; B25D 2216/0069
USPC ..... 173/48, 156
See application file for complete search history.

(56) References Cited

U.S. PATENT DOCUMENTS

| | | | | |
|---|---|---|---|---|
| 1,494,109 A | | 5/1924 | Griner | |
| 1,625,211 A | | 4/1927 | Jones | |
| 2,794,621 A | * | 6/1957 | Beeson | B25D 11/102 173/109 |
| 5,992,538 A | * | 11/1999 | Marcengill | B25D 11/102 173/171 |
| 7,506,693 B2 | * | 3/2009 | Stirm | B25D 11/005 173/104 |

(Continued)

FOREIGN PATENT DOCUMENTS

| | | |
|---|---|---|
| CN | 1206647 A | 2/1999 |
| CN | 1265955 A | 9/2000 |

(Continued)

OTHER PUBLICATIONS

International Search Report for PCT/EP2012/076201, dated Apr. 3, 2013.

*Primary Examiner* — Andrew M Tecco
*Assistant Examiner* — Eyamindae C Jallow
(74) *Attorney, Agent, or Firm* — Norton Rose Fulbright US LLP; Gerard Messina

(57) ABSTRACT

A handheld tool device includes a hammer mechanism that has at least a striker and a cam guide that drives the striker at least in a hammer-drilling mode. The striker has at least a portion of the cam guide.

12 Claims, 11 Drawing Sheets

(56) References Cited

U.S. PATENT DOCUMENTS

| | | | | |
|---|---|---|---|---|
| 7,588,093 | B2 * | 9/2009 | Grand | B25B 21/02 173/109 |
| 2005/0061521 | A1 * | 3/2005 | Saito | B25B 21/02 173/48 |
| 2006/0024141 | A1 | 2/2006 | Schad | |
| 2008/0073092 | A1 * | 3/2008 | Yeoh | B25B 21/02 173/48 |
| 2009/0151966 | A1 * | 6/2009 | Chen | B25B 21/02 173/48 |
| 2010/0071923 | A1 * | 3/2010 | Rudolph | B25B 21/00 173/48 |

FOREIGN PATENT DOCUMENTS

| | | | |
|---|---|---|---|
| CN | 1279145 | A | 1/2001 |
| CN | 1470365 | A | 1/2004 |
| CN | 1907654 | A | 2/2007 |
| DE | 10 68 198 | | 11/1959 |
| DE | 1625211 | A1 | 7/1970 |
| DE | 102004037072 | B3 | 1/2006 |
| EP | 1690642 | A1 | 8/2006 |
| GB | 2423044 | A | 8/2006 |
| JP | 2001009746 | A | 1/2001 |
| JP | 2002-213745 | | 7/2002 |
| SU | 111576 | A1 | 11/1956 |
| WO | WO 2010/069647 | | 6/2010 |

* cited by examiner

E-E

F-F

HANDHELD TOOL DEVICE

BACKGROUND OF THE INVENTION

1. Field of the Invention

The present invention relates to a handheld tool device with a hammer mechanism.

2. Description of the Related Art

Published European Patent Application document EP 1 690 642 A1 has already described a handheld tool device with a hammer mechanism that has at least a striker and a cam guide that drives the striker at least in a hammer-drilling mode.

BRIEF SUMMARY OF THE INVENTION

The present invention proceeds from a handheld tool device with a hammer mechanism that has at least a striker and a cam guide that drives the striker at least in a hammer-drilling mode.

It is provided that the striker has at least a portion of the cam guide. The term "hammer mechanism" is to be understood as meaning especially a device that is intended to produce an impact pulse and to deliver it especially in the direction of an application tool. Preferably, the hammer mechanism transmits the impact pulse to the application tool, at least in a hammer-drilling mode, advantageously via a tool spindle and/or especially via a tool chuck of the handheld tool device. Preferably, the hammer mechanism is intended for translating a rotational motion into a, in particular, translational hammer motion. The term "intended" is to be understood as meaning especially being specifically designed and/or equipped. In particular, the term "striker" is to be understood as meaning an element that, at least in a hammer-drilling mode, is accelerated, in particular translationally and that delivers a pulse received during the acceleration as an impact pulse in the direction of the application tool. Preferably, the striker is constructed in one piece. Alternatively, the striker could be of a multi-part configuration. In particular, a "cam guide" is to be understood as being a device that translates rotational energy into linear motion energy of the striker to produce an impact at least with the aid of a specially shaped guide surface along which a connecting element runs at least in a hammer-drilling mode. Preferably, the hammer mechanism has a hammer mechanism spring which stores the linear motion energy of the striker to produce an impact. Preferably, the specially shaped surface is a surface that delimits a guide cam of the cam guide.

A "connecting element" is to be understood especially as being an element that produces a mechanical coupling between at least one part of the hammer mechanism, which part is moved in rotation in a hammer-drilling mode, especially a hammer mechanism spindle, and the striker which is moved, in particular, linearly. In particular, a "guide cam" is to understood as being a region that is delimited by the guide surface and in which the connecting element runs in at least one operating state. A "hammer mechanism spring" is to be understood especially as being a spring that stores at least some of an impact energy in at least one operating state. In particular, the term "support" is to be understood as meaning that a portion of the hammer mechanism spring is disposed so as to be immobile relative to the striker, or a portion of the hammer mechanism spring is disposed so as to be immobile relative to a handheld tool housing. The hammer mechanism spring is configured as a spring considered suitable by one skilled in the art, but preferably is configured as a helical spring. The term "drive" is to be understood in this context as meaning especially that the cam guide transmits to the striker an energy for producing an impact.

The expression "the striker has at least a portion of the cam guide" is to be understood especially as meaning that the striker has a surface to which the connecting element directly transmits the energy for producing the impact motion. Preferably, the portion of the cam guide belonging to the striker is configured as a surface that fastens the connecting element in a fixed position relative to the striker. Advantageously, the portion of the cam guide belonging to the striker includes a fastening recess which is delimited by the surface and which fastens the connecting element in a fixed position relative to the striker. Advantageously, the striker is intended to fasten a connecting element that in an operation connects the portion of the cam guide and a further portion of the cam guide, especially the guide cam.

Preferably, the connecting element and the striker are connected in an unsprung manner. That means, in particular, that no spring is operatively disposed between the connecting element and the striker. Alternatively, the connecting element could be constructed at least partially in one piece with the striker. Furthermore, as an alternative, the portion of the cam guide belonging to the striker could be configured as a guide cam. The expression "in a fixed position" is to be understood especially as meaning that an axis of symmetry and/or a center point of the connecting means is at least substantially motionless relative to the striker in a hammer mode. The configuration according to the invention of the handheld tool device is able to provide an especially small, light-weight and nevertheless effective hammer mechanism. In particular, it is advantageously possible to dispense with a wobble bearing or a rocker lever.

In a further embodiment, it is provided that the cam guide has an impact free-running region, whereby, with a short overall length, a high impact energy and an advantageously low degree of wear may be achieved. An "impact free-running region" is to be understood especially as being a region of the guide cam of the cam guide, in which region the connecting element is disposed when the hammer mechanism spring accelerates the striker in the impact direction. Preferably, the impact free-running region is constructed to be so wide that the connecting element is able to run through the impact free-running region on different paths. Preferably, the impact free-running region does not cause any force on the striker, at least in the hammer-drilling mode.

Furthermore, it is provided that the cam guide has an impact pull-up region, whereby advantageous operation, especially with little vibration, may be achieved. In particular, an "impact pull-up region" is to be understood as being a region of the guide cam of the cam guide, which region moves the striker, at least in a hammer-drilling mode, especially relative to the handheld tool housing counter to the impact direction. Preferably, the movement of the striker counter to the impact direction, which is caused by the impact pull-up region, compresses the hammer mechanism spring. Preferably, the guide surface of the impact pull-up region has an inclination relative to the impact direction of from 5 degrees to 35 degrees, preferably from 10 degrees to 25 degrees.

It is further provided that the cam guide has a mounting aperture, whereby advantageous mounting and an especially small construction are possible. A "mounting aperture" is to be understood especially as being a region delimited by the hammer mechanism spindle and/or the striker, through which the connecting element is introduced into the guide cam during mounting.

In addition, it is provided that the hammer mechanism includes a hammer mechanism spindle which has at least a portion of the cam guide, whereby a compact configuration may be achieved. A "hammer mechanism spindle" is to be understood especially as being a shaft that transmits rotational motion from a planetary gear of the handheld tool device to the cam guide. Preferably, the hammer mechanism spindle is in the form of a hollow shaft.

It is furthermore provided that the hammer mechanism spindle has a guide cam of the cam guide, whereby simple manufacture is possible. Alternatively or in addition, the hammer mechanism spindle could have a fastening recess for fastening of the connecting element in a fixed position relative to the hammer mechanism spindle and/or could be constructed at least partially in one piece with the connecting element.

In one advantageous embodiment of the present invention, it is provided that the striker at least substantially surrounds the hammer mechanism spindle on at least one plane, whereby a configuration of low volume and weight is possible. In particular, the expression "at least substantially surround on at least one plane" is to be understood as meaning that radial lines emanating from an axis of the hammer mechanism spindle and disposed on the plane will intersect the striker over an angle range of at least 180 degrees, advantageously at least 270 degrees. Especially advantageously, the striker surrounds the hammer mechanism spindle by 360 degrees.

In a further embodiment, it is provided that the hammer mechanism has a connecting element which in at least one operating state transmits a motion especially from the hammer mechanism spindle to the striker, whereby a low degree of wear, efficient production and simple mounting may be achieved.

Furthermore, it is provided that the handheld tool device has a tool spindle which the striker at least substantially surrounds on at least one plane. A "tool spindle" is to be understood as being especially a shaft that transmits rotational motion from the planetary gear to the tool chuck. Preferably, the tool spindle is in the form of a solid shaft. Alternatively, the tool spindle could be in the form of a hollow shaft.

It is further provided that the tool spindle is disposed at least substantially coaxially with the hammer mechanism spindle, whereby an especially compact configuration is possible. In particular, the expression "disposed at least substantially coaxially" is to be understood as meaning that, at at least one point, a rotation axis of the tool spindle and a rotation axis of the hammer mechanism spindle are spaced from each other by less than 20 mm, advantageously less than 10 mm, and have an orientation difference of less than 15 degrees, advantageously less than 5 degrees, from each other. Especially preferably, the rotation axis of the tool spindle and the rotation axis of the hammer mechanism spindle are disposed on an identical straight line and have an identical orientation.

In addition, it is provided that the hammer mechanism has a striker guide which supports the striker in a rotationally rigid manner, whereby a constructionally simple cam guide is possible. A "striker guide" is to be understood especially as being a device that supports the striker to be movable parallel to the impact direction. In particular, the expression "support in a rotationally rigid manner" is to be understood as meaning that the striker guide opposes in particular any rotational movement of the striker relative to a handheld tool housing.

It is further provided that the handheld tool device includes a handheld tool housing, the hammer mechanism having a hammer mechanism spring which is supported on the striker and on the handheld tool housing, whereby an especially small overall axial length may be achieved. In particular, a "handheld tool housing" is to be understood as being a housing having an interior space in which at least the hammer mechanism, the planetary gear, and a drive unit of the handheld tool housing are disposed.

Preferably, the handheld tool housing connects at least the hammer mechanism, the planetary gear, and a drive unit of the handheld tool housing at least partially to one another.

In one advantageous embodiment of the present invention, it is provided that the hammer mechanism has the first cam guide and a second cam guide, whereby a low degree of wear and a high smoothness of running are possible.

In addition, the present invention proceeds from a handheld tool having a handheld tool device according to the invention. Preferably, the handheld tool is intended to drive the application tool in a screwing mode, in a drilling mode, in a screwing/drilling mode and especially in a chisel mode.

DETAILED DESCRIPTION OF THE INVENTION

Figure 1:
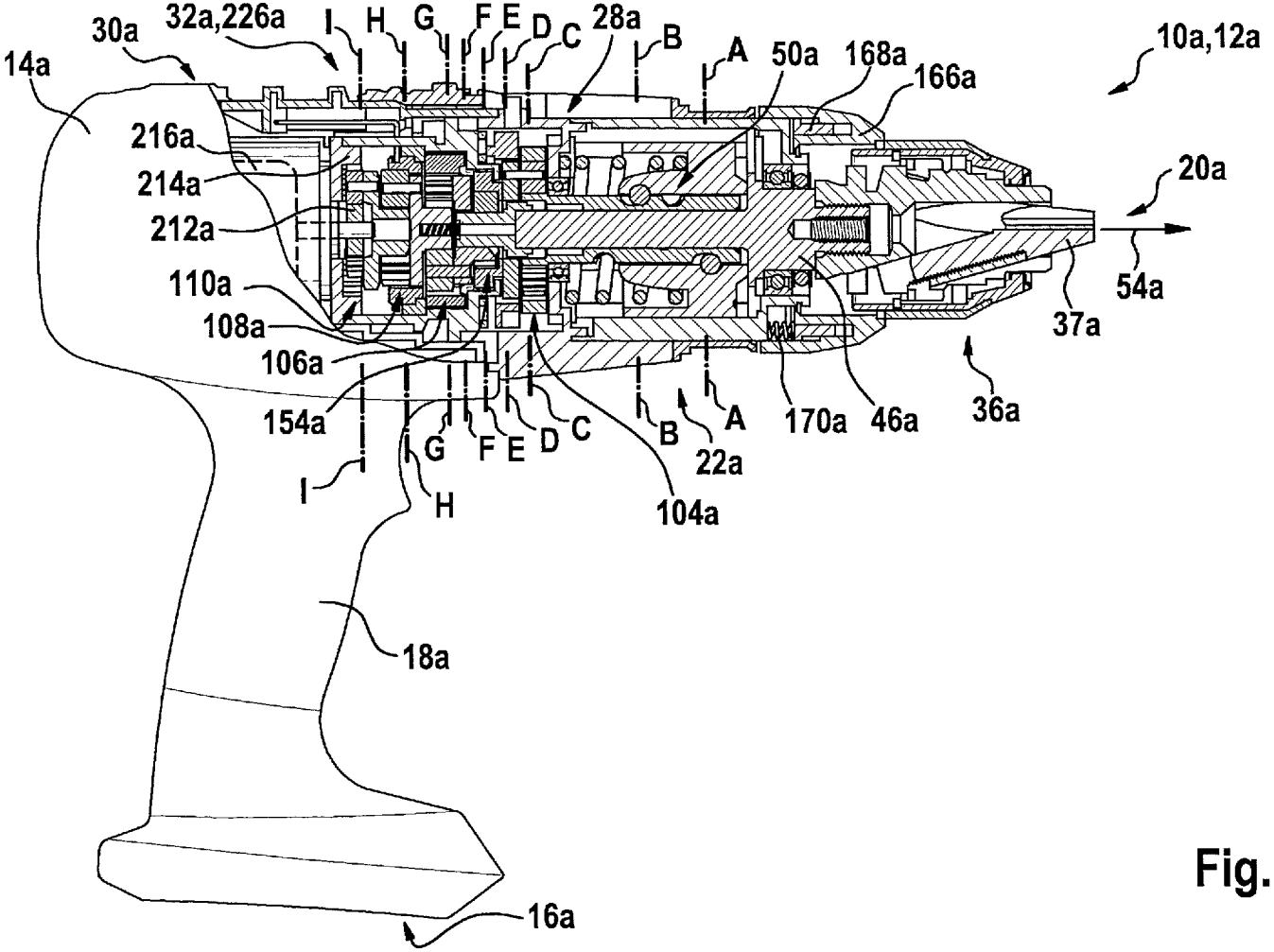
FIG. 1 shows a section of a handheld tool with a handheld tool device according to the invention.

FIG. 1 shows a handheld tool 10*a*. Handheld tool 10*a* is in the form of a hammer drill driver. Handheld tool 10*a* has a handheld tool device 12*a* according to the invention, a handheld tool housing 14*a* and a battery interface 16*a*. Battery interface 16*a* is intended to supply handheld tool device 12*a* with electrical energy from a handheld tool battery, not shown. Handheld tool housing 14*a* is of a pistol-shaped configuration. Handheld tool housing 14*a* is of a multi-part configuration. It includes a hand grip 18*a* with which an operator holds the handheld tool 10*a* during a work operation. Handheld tool device 12*a* includes a tool guiding unit 20*a*, a hammer mechanism 22*a*, a first impact deactivation device 24*a*, a second impact deactivation device 26*a*, a planetary gear 28*a*, a drive unit 30*a*, an operating device 32*a*, and a torque limiting unit 34*a*.

Tool guiding unit 20*a* includes a tool chuck 36*a* and a tool spindle 38*a*. During a work operation, tool chuck 36*a* fastens an application tool, not shown here, for example a drill bit or a driver bit. Tool chuck 36*a* fastens the application tool non-positively. Tool chuck 36*a* has three clamping jaws which are movably fastened by an operator and which fasten the application tool in a work operation. In addition, tool chuck 36*a* fastens the application tool in such a way that it is axially immobile relative to tool chuck 36*a* and especially tool spindle 38*a* in a work operation. A portion of tool chuck 36*a* and tool spindle 38*a* are connected to each other in such a way as to be immobile relative to each other. In this case, tool chuck 36*a* and tool spindle 38*a* are screwed to each other. Handheld tool device 12*a* has a bearing element 40*a* which supports tool spindle 38*a* on a side toward tool chuck 36*a*. Bearing element 40*a* supports tool spindle 38*a* in an axially displaceable manner. Bearing element 40*a* is connected to tool spindle 38*a* in an axially fixed manner. Bearing element 40*a* is supported to be axially movable in handheld tool housing 14*a*. Handheld tool device 12*a* has a further bearing element 41*a* which supports tool spindle 38*a* on a side toward planetary gear 28*a*. Bearing element 41*a* is in the form of a rolling bearing, in this case a needle bearing, whereby low-backlash support is possible. Bearing element 41*a* supports tool spindle 38*a* in an axially displaceable manner. A hammer mechanism spindle 46*a* surrounds bearing element 41*a*. Bearing element 41*a* is operatively disposed between tool spindle 38*a* and hammer mechanism spindle 46*a*.

Tool spindle 38*a* includes an impact face 42*a* on which a striker 44*a* of hammer mechanism 22*a* strikes in a hammer-drilling mode. Striker 44*a* has a mass that is at most two thirds as great as a mass of tool guiding unit 20*a*. In this case, the mass of striker 44*a* is less than half as great as the mass of tool guiding unit 20*a*. The mass of striker 44*a* is approximately 45% of the mass of tool guiding unit 20*a*.

Figure 2:
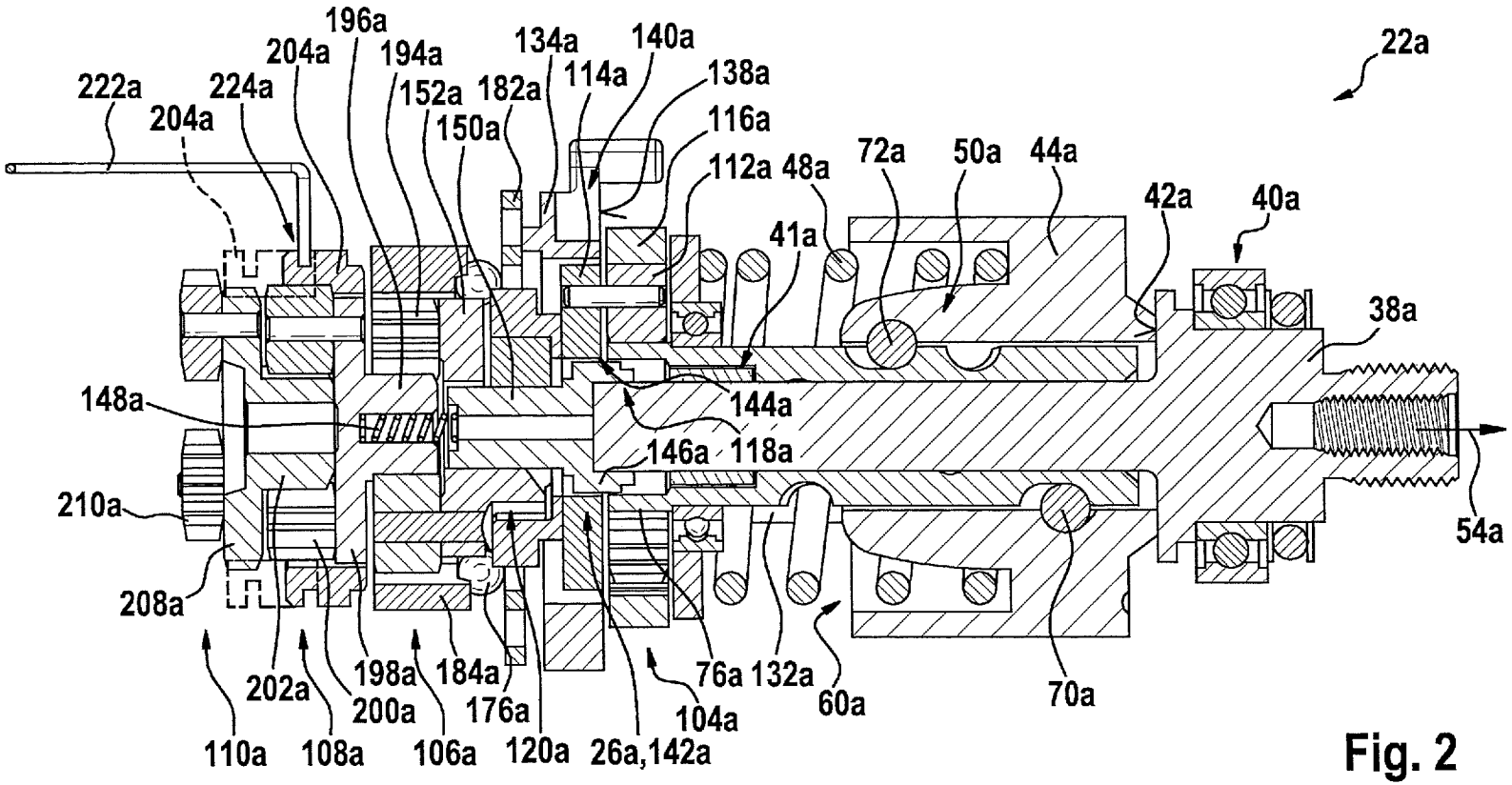
FIG. 2 shows a partially isolated section through a hammer mechanism and a planetary gear of the handheld tool device of FIG. 1.

In FIG. 2, hammer mechanism 22*a* and planetary gear 28*a* are illustrated in greater detail. Hammer mechanism 22*a* has striker 44*a*, hammer mechanism spindle 46*a*, a hammer mechanism spring 48*a*, a striker driving device 50*a*, and a striker guide 52*a*. Striker 44*a* is supported to be movable translationally in impact direction 54*a*. Impact direction 54*a* is oriented parallel to an axial direction of hammer mechanism spindle 46*a*.

Figure 3:
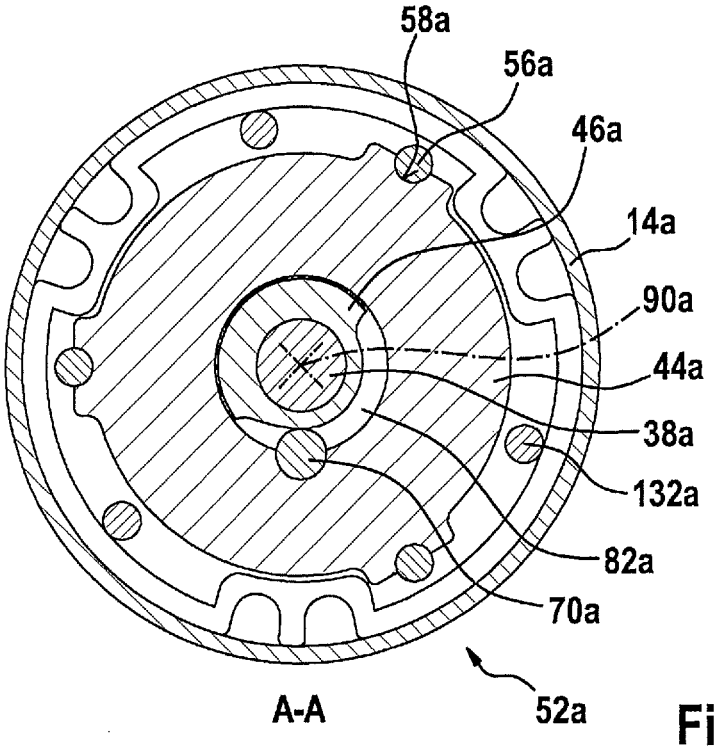
FIG. 3 shows a first plane of section A of the hammer mechanism of the handheld tool device of FIG. 1.
Figure 4:
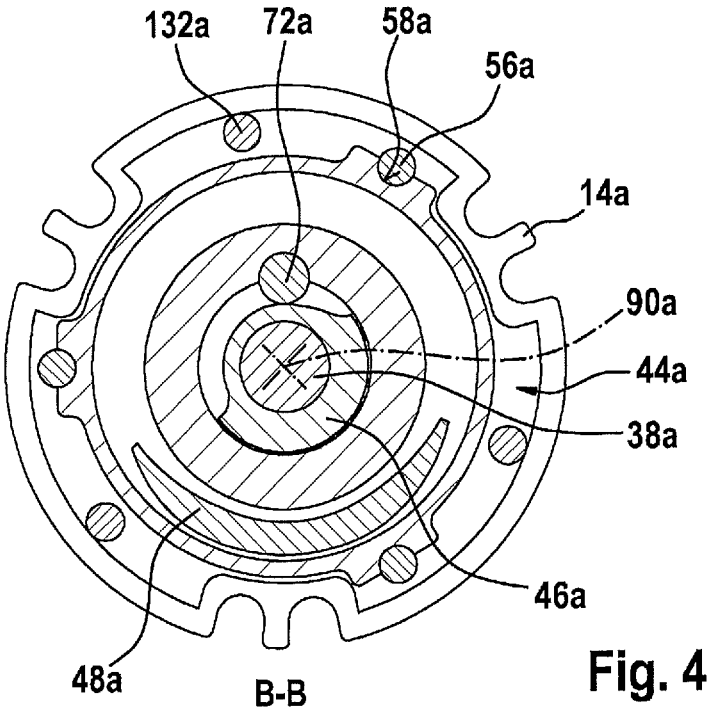
FIG. 4 shows a second plane of section B of the hammer mechanism of the handheld tool device of FIG. 1.

FIGS. 3 and 4 show a plane of section A and a plane of section B of hammer mechanism 22*a*. Striker guide 52*a* supports striker 44*a* in a rotationally rigid manner relative to handheld tool housing 14*a*. Striker guide 52*a* has three guide rods 56*a* on which striker 44*a* slides. Guide rods 56*a* are disposed at uniform intervals about striker 44*a*. Striker 44*a* has slide surfaces 58*a* which surround guide rods 56*a* by 180 degrees on a plane perpendicular to impact direction 54*a*. Striker 44*a* surrounds hammer mechanism spindle 46*a* by 360 degrees on a plane oriented perpendicularly to impact direction 54*a*. In addition, striker 44*a* surrounds tool spindle 38*a* on the plane by 360 degrees. Furthermore, hammer mechanism spindle 46*a* surrounds tool spindle 38*a* on the plane by 360 degrees. Hammer mechanism spindle 46*a* is disposed coaxially with tool spindle 38*a*.

Figure 5:
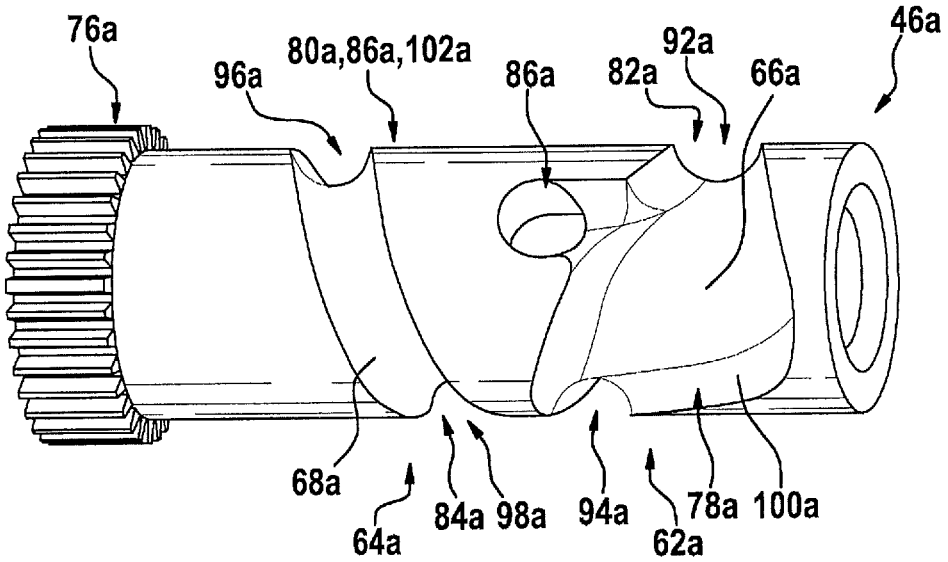
FIG. 5 shows a perspective view of a hammer mechanism spindle of the hammer mechanism of the handheld tool device of FIG. 1.
Figure 6:
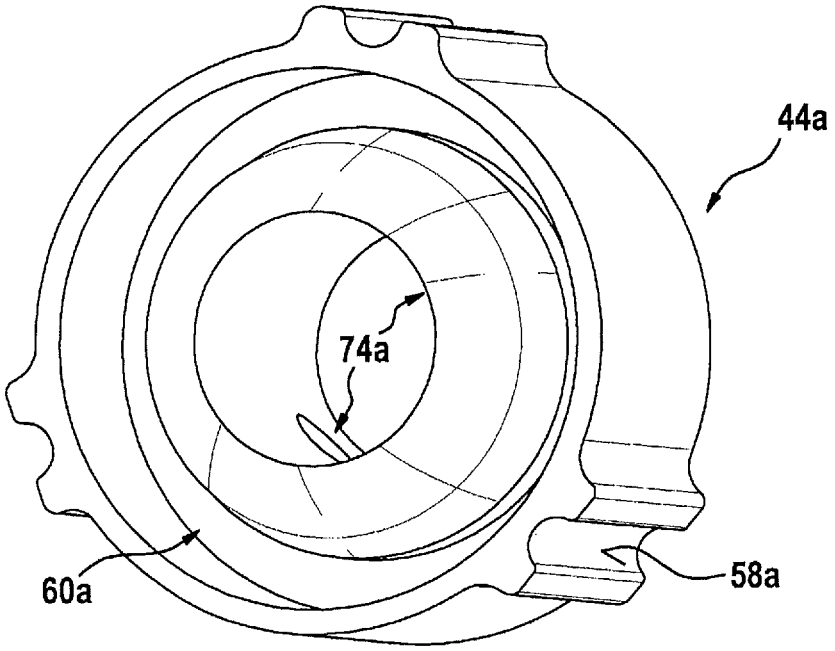
FIG. 6 shows a perspective view of a striker of the hammer mechanism of the handheld tool device of FIG. 1.

Hammer mechanism spring 48*a* accelerates striker 44*a* in impact direction 54*a* prior to an impact. For that purpose, handheld tool housing 14*a* supports hammer mechanism spring 48*a* on a side remote from striker 44*a*. Hammer mechanism spring 48*a* presses directly against striker 44*a*. Striker 44*a* has a spring fastening 60*a*. Spring fastening 60*a* is in the form of an annular depression. FIG. 5 shows hammer mechanism spindle 46*a* in perspective. FIG. 6 shows striker 44*a* in perspective. Striker driving device 50*a* has a first cam guide 62*a* and a second first cam guide 64*a*. Cam guides 62*a*, 64*a* each include a respective guide cam 66*a*, 68*a* and a respective connecting element 70*a*, 72*a*. Connecting elements 70*a*, 72*a* are of a spherical configuration. Striker 44*a* supports connecting elements 70*a*, 72*a* in a fixed position relative to striker 44*a*. Striker 44*a* has hemispherical fastening recesses 74*a*. Connecting elements 70*a*, 72*a* slide in guide cam 66*a*, 68*a* in a hammer-drilling mode. Hammer mechanism spindle 46*a* has a portion of cam guides 62*a*, 64*a*, namely guide cam 66*a*, 68*a*. Hammer mechanism spindle 46*a* delimits a space in which connecting elements 70*a*, 72*a* move in a hammer-drilling mode.

Hammer mechanism spindle 46*a* is in the form of a hollow shaft. Planetary gear 28*a* drives hammer mechanism spindle 46*a*. For that purpose, hammer mechanism spindle 46*a* has toothing 76*a* on a side remote from tool chuck 36*a*. Guide cams 66*a*, 68*a* each have an impact free-running region 78*a*, 80*a*, an impact pull-up region 82*a*, 84*a* and a mounting aperture 86*a*, 88*a*. In a mounting operation, connecting elements 70*a*, 72*a* are introduced into fastening recesses 74*a* of striker 44*a* through mounting apertures 86*a*, 88*a*. Hammer mechanism spindle 46*a* rotates in the hammer-drilling mode in the clockwise direction as viewed in impact direction 54*a*. Impact pull-up regions 82*a*, 84*a* are of a helical configuration. They extend through 180 degrees about a rotation axis 90*a* of hammer mechanism spindle 46*a*. Impact pull-up regions 82*a*, 84*a* move connecting elements 70*a*, 72*a* and hence striker 44*a* counter to impact direction 54*a* in the hammer-drilling mode. Accordingly, hammer mechanism 22*a* includes connecting elements 70*a*, 72*a* which, in at least one operating state, transmit a motion from hammer mechanism spindle 46*a* to striker 44*a*.

Impact free-running regions 78*a*, 80*a* each connect two ends 92*a*, 94*a*, 96*a*, 98*a* of impact pull-up regions 82*a*, 84*a*. Impact free-running regions 78*a*, 80*a* extend through 180 degrees about a rotation axis 90*a* of hammer mechanism spindle 46*a*. Impact free-running regions 78*a*, 80*a* each have an impact flank 100*a*, 102*a* which, starting from an end 94*a*, 96*a* of impact pull-up region 82*a* toward planetary gear 28*a*, runs approximately parallel to impact direction 54*a*. Once connecting elements 70*a*, 72*a* penetrate into impact free-running regions 78*a*, 80*a*, hammer mechanism spring 48*a* accelerates striker 44*a* and connecting elements 70*a*, 72*a* in impact direction 54*a*. In the process, connecting elements 70*a*, 72*a* move through impact free-running regions 78*a*, 80*a*, without experiencing an axial force, until striker 44*a* meets impact face 42*a*. Cam guides 62*a*, 64*a* are disposed offset by 180 degrees about rotation axis 90*a*. Cam guides 62*a*, 64*a* are disposed one behind the other in the axial direction.

Figure 7:
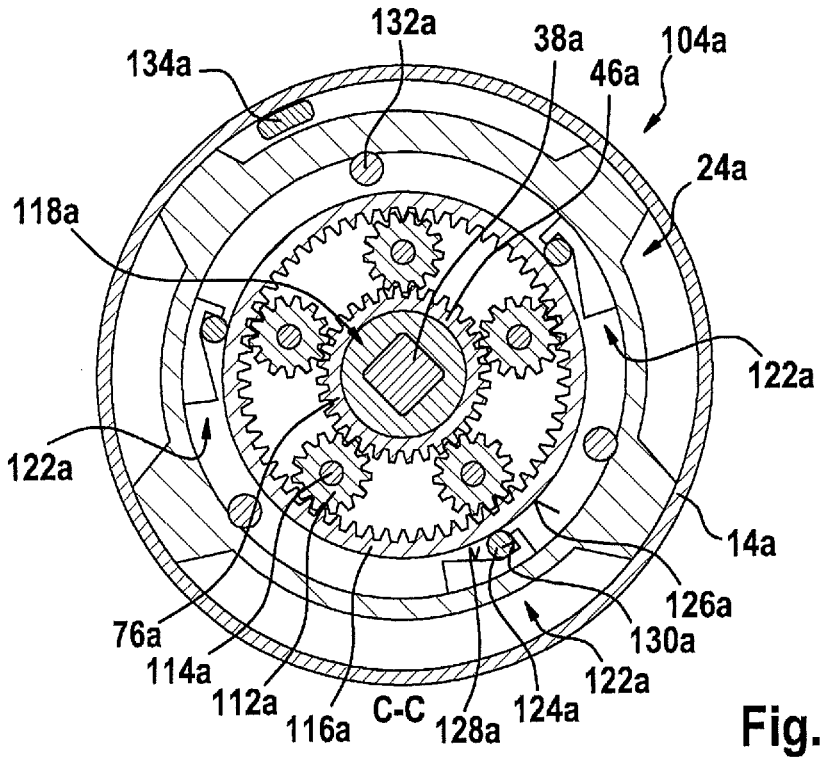
FIG. 7 shows a plane of section C of a first planetary gear stage and a first impact deactivation device of the handheld tool device of FIG. 1.

Planetary gear 28*a* has first planetary gear stage 104*a*, a second planetary gear stage 106*a*, a third planetary gear stage 108*a* and a fourth planetary gear stage 110*a*. FIG. 7 shows a plane of section C of first planetary gear stage 104*a*. Planetary gear stages 104*a*, 106*a*, 108*a*, 110*a* illustrated in FIGS. 7, 12, 13 and 15 have gearwheels with a number of teeth considered suitable by one skilled in the art. The gearwheels of planetary gear stages 104*a*, 106*a*, 108*a*, 110*a* are in engagement with one another, which in some cases is not shown in that form here. First planetary gear stage 104*a* increases a first rotational speed of second planetary gear stage 106*a* to drive hammer mechanism 22*a*. Second planetary gear stage 106*a* drives tool spindle 38*a* at that first rotational speed. Toothing 76*a* of hammer mechanism spindle 46*a* forms a sun gear of first planetary gear stage 104*a*. Toothing 76*a* meshes with planet gears 112*a* of first planetary gear stage 104*a* which are guided by a planet carrier 114*a* of first planetary gear stage 104*a*. A ring gear 116*a* of first planetary gear stage 104*a* meshes with planet gears 112*a* of first planetary gear stage 104*a*.

First impact deactivation device 24*a* fixes ring gear 116*a* of first planetary gear stage 104*a* immovably relative to handheld tool housing 14*a* in a hammer-drilling mode. First impact deactivation device 24*a* is intended to switch on striker driving device 50*a* in a first, clockwise drilling rotational direction and to automatically switch off striker driving device 50*a* in a second, anticlockwise drilling rotational direction. First impact deactivation device 24*a* acts on ring gear 116*a* of first planetary gear stage 104*a*. First impact deactivation device 24*a* locks ring gear 116*a* of first planetary gear stage 104*a* in the first, clockwise drilling rotational direction. First impact deactivation device 24*a* releases ring gear 116*a* of first planetary gear stage 104*a* in the second, anticlockwise drilling rotational direction, so that it is able to rotate. For that purpose, first impact deactivation device 24*a* has three clamping mechanisms 122*a*. Clamping mechanisms 122*a* each include a blocking element 124*a*, a first clamping face 126*a*, a second clamping face 128*a*, and free-running faces 130*a*. Blocking element 124*a* is in the form of a roller. First clamping face 126*a* forms an external region of a surface of ring gear 116*a* of first planetary gear stage 104*a*. Second clamping face 128*a* is disposed immovably relative to handheld tool housing 14*a*. Upon operation in the first, clockwise drilling rotational direction, blocking elements 124*a* become jammed between first clamping faces 126*a* and second clamping face 128*a*. Upon operation in the second, anticlockwise drilling rotational direction, free-running faces 130*a* guide blocking elements 124*a* and prevent jamming.

In addition, FIG. 7 shows a connecting element 118*a* which connects tool spindle 38*a* and a planet carrier 120*a* of second planetary gear stage 106*a* in a rotationally rigid manner. Connecting element 118*a* connects tool spindle 38*a* and planet carrier 120*a* of second planetary gear stage 106*a* in an axially displaceable manner in this case.

Figure 8:
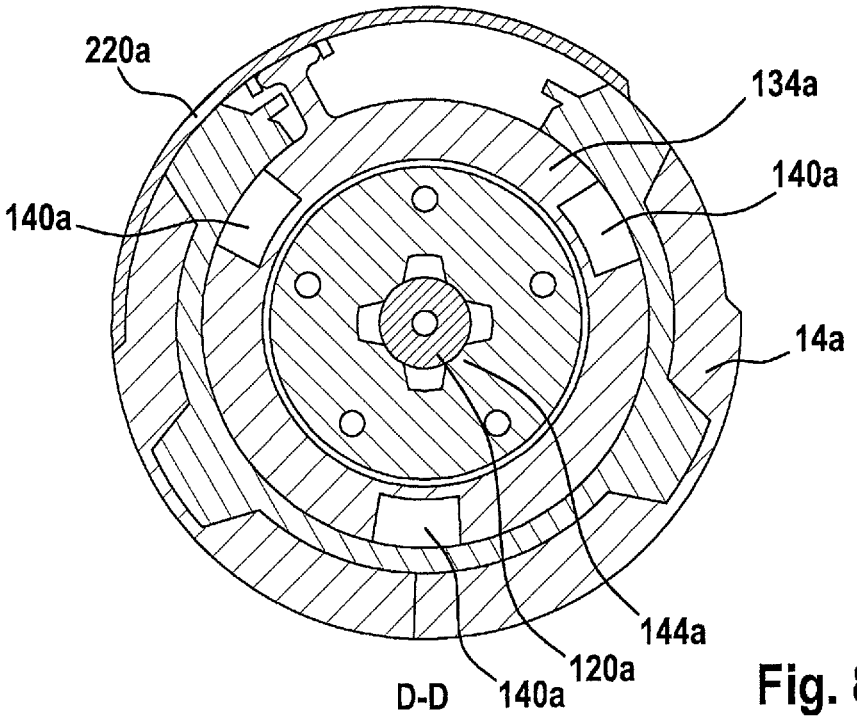
FIG. 8 shows a plane of section D of a control element and a second impact deactivation device of the handheld tool device of FIG. 1.
Figure 9:
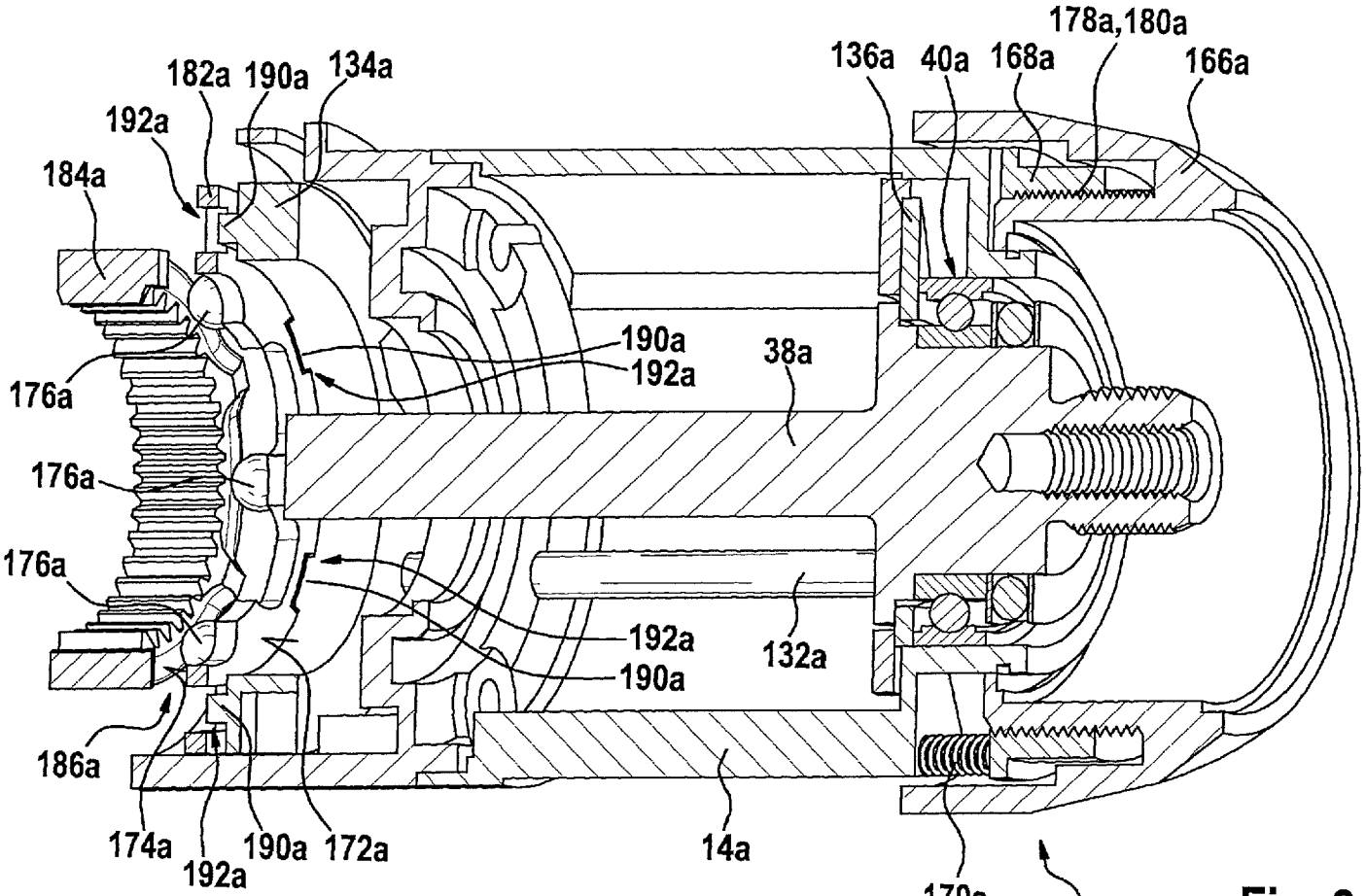
FIG. 9 shows a perspective view in section of a portion of the handheld tool device of FIG. 1.

FIGS. 3, 4 and 7 further show three first transmission elements 132*a* of second impact deactivation device 26*a*. Transmission elements 132*a* are in the form of rods. FIG. 8 shows a plane of section D through a control element 134*a* of handheld tool device 12*a*. FIG. 9 shows second impact deactivation device 26*a* in a perspective view in section. Control element 134*a* supports tool guiding unit 20*a* in a screwing mode, illustrated in FIGS. 1, 8 and 9, and in a drilling mode in a direction counter to impact direction 54*a*. A force exerted on tool guiding unit 20*a* acts, via bearing element 40*a*, a second transmission element 136*a* of second impact deactivation device 26*a* and first transmission elements 132*a*, on support faces 138*a* of control element 134*a*. Control element 134*a* has three apertures 140*a*. In a hammer-drilling mode illustrated in FIG. 2, first transmission elements 132*a* may be pushed into apertures 140*a*, whereby tool guiding unit 20*a* is axially movable.

Second impact deactivation device 26*a* has an impact deactivation coupling 142*a*. Impact deactivation coupling 142*a* is formed partially in one piece with planetary gear 28*a*. Impact deactivation coupling 142*a* is disposed between first planetary gear stage 104*a* and second planetary gear stage 106*a*. Impact deactivation coupling 142*a* has a first coupling element 144*a* which is connected to a planet carrier 114*a* of first planetary gear stage 104*a* in a rotationally rigid manner. Impact deactivation coupling 142*a* has a second coupling element 146*a* which is connected to a planet carrier 120*a* of second planetary gear stage 106*a* in a rotationally rigid manner. In the screwing mode illustrated and in the drilling mode, impact deactivation coupling 142*a* is open. In a hammer-drilling operation, tool spindle 38*a* transmits an axial coupling force to impact deactivation coupling 142*a* when the operator presses an application tool against a workpiece. The coupling force closes impact deactivation coupling 142*a*. In FIG. 2, impact deactivation coupling 142*a* is shown closed. When the operator removes the application tool from the workpiece, an impact switch spring 148*a* of handheld tool device 12*a* opens impact deactivation coupling 142*a*.

Planet carrier 120*a* of second planetary gear stage 106*a* is constructed in two parts. A first part 150*a* of planet carrier 120*a* of second planetary gear stage 106*a* is connected to tool spindle 38*a* in a rotationally rigid manner. First part 150*a* of planet carrier 120*a* is connected to tool spindle 38*a* in an axially displaceable manner, whereby planet carrier 120*a* remains rotationally coupled to tool spindle 38*a* also during an impact. Accordingly, first part 150*a* is permanently connected to tool spindle 38*a*. First part 150*a* of planet carrier 120*a* is supported to be axially displaceable toward impact switch spring 148*a*. A second part 152*a* of planet carrier 120*a* of second planetary gear stage 106*a* is connected to first part 150*a* of planet carrier 120*a* in a rotationally rigid manner. First part 150*a* and second part 152*a* of planet carrier 120*a* are connected in such a manner as to be axially displaceable relative to each other. First part 150*a* and second part 152*a* of planet carrier 120*a* are connected in a permanently rotationally rigid manner.

Figure 10:
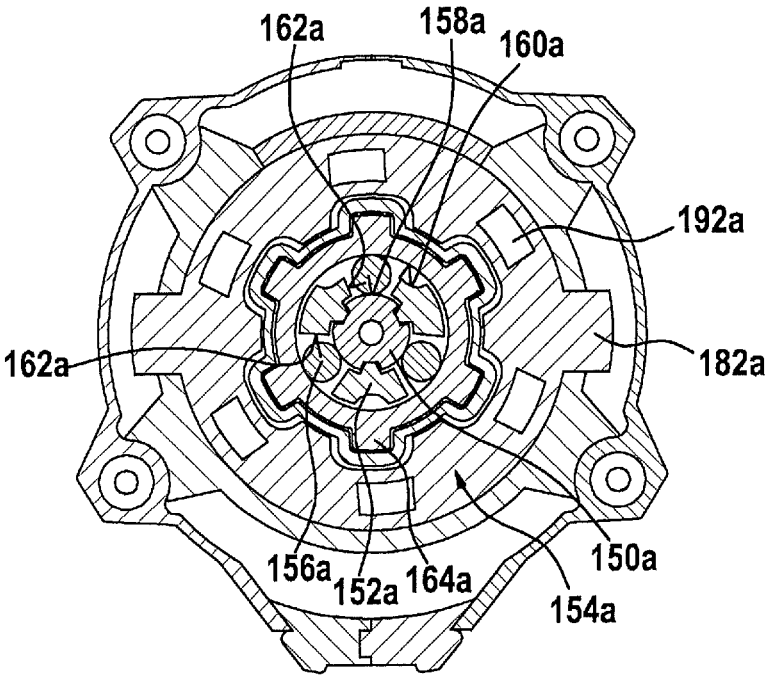
FIG. 10 shows a plane of section E of a spindle locking device of the handheld tool device of FIG. 1.

FIG. 10 shows a plane of section of a spindle locking device 154*a* of handheld tool device 12*a*. Spindle locking device 154*a* is intended to connect tool spindle 38*a* to handheld tool housing 14*a* in a rotationally rigid manner when a tool torque is applied to tool chuck 36*a*, for example when an application tool is being clamped into tool chuck 36*a*. Spindle locking device 154*a* is constructed partially in one piece with planet carrier 120*a* of second planetary gear stage 106*a*. Spindle locking device 154*a* has blocking elements 156*a*, first clamping faces 158*a*, a second clamping face 160*a*, and free-running faces 162*a*. Blocking elements 156*a* are cylindrical. First clamping faces 158*a* are in the form of regions of a surface of first part 150*a* of planet carrier 120*a* of second planetary gear stage 106*a*. First clamping faces 158*a* are flat. Second clamping face 160*a* is in the form of an inner side of a clamping ring 164*a* of spindle locking device 154*a*. Clamping ring 164*a* is connected to handheld tool housing 14*a* in a rotationally rigid manner. Free-running faces 162*a* are in the form of regions of a surface of second part 152*a* of planet carrier 120*a* of second planetary gear stage 106*a*. When a tool torque is applied to tool chuck 36*a*, blocking elements 156*a* become jammed between first clamping faces 158*a* and second clamping face 160*a*. When drive unit 30*a* drives, free-running faces 162*a* guide blocking elements 156*a* over a circular path and prevent jamming. First part 150*a* and second part 152*a* of planet carrier 120*a* are meshed with each other with clearance.

Figure 11:
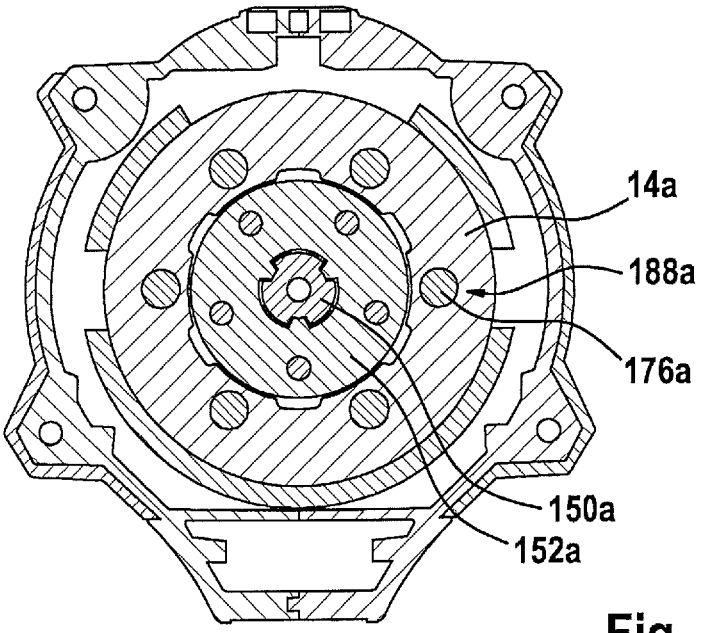
FIG. 11 shows a plane of section F through blocking elements of the spindle locking device of the handheld tool device of FIG. 1.

FIGS. 1, 2, 9 and 10 show torque limiting unit 34*a*. Torque limiting unit 34*a* is intended to limit a maximum tool torque delivered by tool chuck 36*a* in a screwing mode. Torque limiting unit 34*a* includes an operating element 166*a*, an adjusting element 168*a*, limiting springs 170*a*, transmission elements, not shown, first stop faces 172*a*, a second stop face 174*a* and limiting elements 176*a*. Operating element 166*a* is of an annular configuration. It adjoins tool chuck 36*a* in the direction of planetary gear 28*a*. Operating element 166*a* has a setting thread 178*a* which is coupled to a setting thread 180*a* of adjusting element 168*a*. Adjusting element 168*a* is supported in a rotationally rigid and axially displaceable manner. Rotation of operating element 166*a* displaces adjusting element 168*a* in the axial direction. Limiting springs 170*a* are supported on one side against adjusting element 168*a*. Limiting springs 170*a* are supported on another side on a stop element 182*a* of torque limiting unit 34*a* via the transmission elements. A surface of stop element 182*a* has first stop faces 172*a*. Stop element 182*a* is supported to be movable in the axial direction toward limiting springs 170*a* in the screwing mode. Second stop face 174*a* is in the form of a region of a surface of a ring gear 184*a* of second planetary gear stage 106*a*. Second stop face 174*a* has trough-shaped depressions 186*a*. Limiting elements 176*a* are spherical. Limiting elements 176*a* are supported to be displaceable in impact direction 54*a* in tubular apertures 188*a*. FIG. 11 shows a plane of section F of torque limiting unit 34*a*. In a screwing operation, limiting elements 176*a* are disposed in trough-shaped depressions 186*a*. In that case, limiting elements 176*a* fasten ring gear 184*a* of second planetary gear stage 106*a* in a rotationally rigid manner. When the set maximum tool torque is reached, limiting elements 176*a* press stop element 182*a* away toward limiting springs 170*a*. Then limiting elements 176*a* each jump into the next one of trough-shaped depressions 186*a*. In that operation, ring gear 184*a* of second planetary gear stage 106*a* rotates, as a result of which the screwing operation is interrupted.

Control element 134*a* of handheld tool device 12*a* has support elements 190*a* which prevent axial movement of stop element 182*a* at least in a drilling mode. For that purpose, support elements 190*a* support stop element 182*a* in the axial direction. Stop element 182*a* has screw apertures 192*a* which stop elements 182*a* enter when the maximum tool torque is reached in a screwing mode illustrated especially in FIG. 9. Support elements 190*a* are disposed accordingly in a screw position of control element 134*a*. In a hammer-drilling mode, support elements 190*a* also prevent axial movement of stop element 182*a* and hence a response of torque limiting unit 34*a*.

Alternatively, stop elements could also be so disposed in a hammer-drilling mode that they are able to enter screw apertures. In that manner, a torque limiting unit would be active in the hammer-drilling mode.

Figure 12:
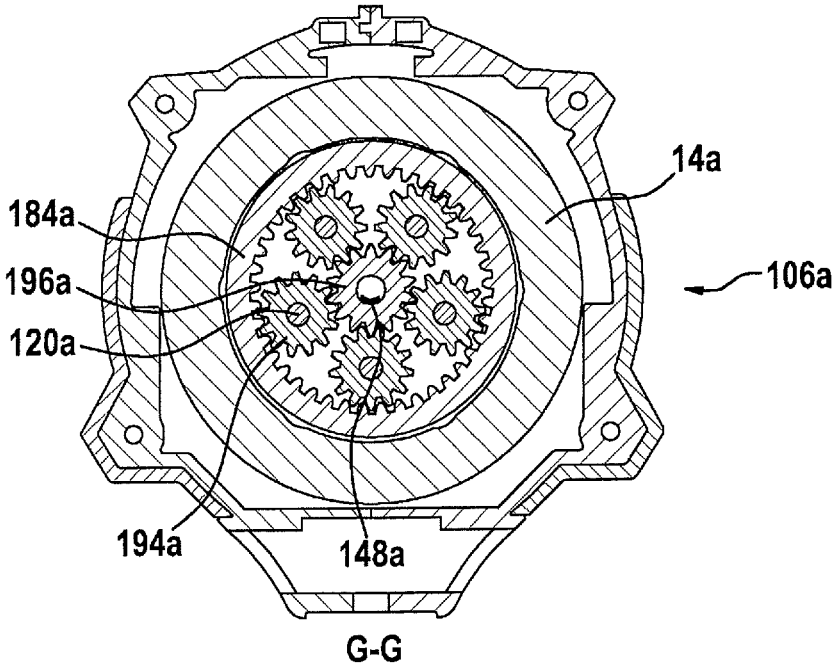
FIG. 12 shows a plane of section G of a second planetary gear stage of the handheld tool device of FIG. 1.

FIG. 12 shows a plane of section G of second planetary gear stage 106*a*. Ring gear 184*a* of second planetary gear stage 106*a* is secured against complete rotation in handheld tool housing 14*a* at least in a drilling mode. Planet gears 194*a* of second planetary gear stage 106*a* mesh with ring gear 184*a* and a sun gear 196*a* of second planetary gear stage 106*a*.

Figure 13:
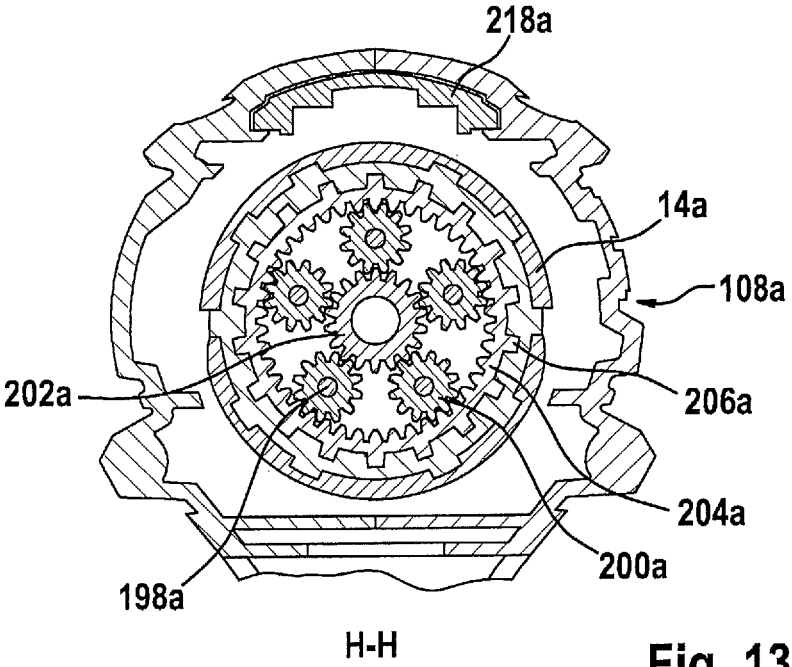
FIG. 13 shows a plane of section H of a third planetary gear stage of the handheld tool device of FIG. 1.

FIG. 13 shows a plane of section H of third planetary gear stage 108*a*. Sun gear 196*a* of second planetary gear stage 106*a* is connected to a planet carrier 198*a* of third planetary gear stage 108*a* in a rotationally rigid manner. Planet gears 200*a* of third planetary gear stage 108*a* mesh with a sun gear 202*a* and a ring gear 204*a* of third planetary gear stage 108*a*. Ring gear 204*a* of third planetary gear stage 108*a* has toothing 206*a* which connects ring gear 204*a* of third planetary gear stage 108*a* to handheld tool housing 14*a* in a rotationally rigid manner in a first gear ratio.

Figure 14:
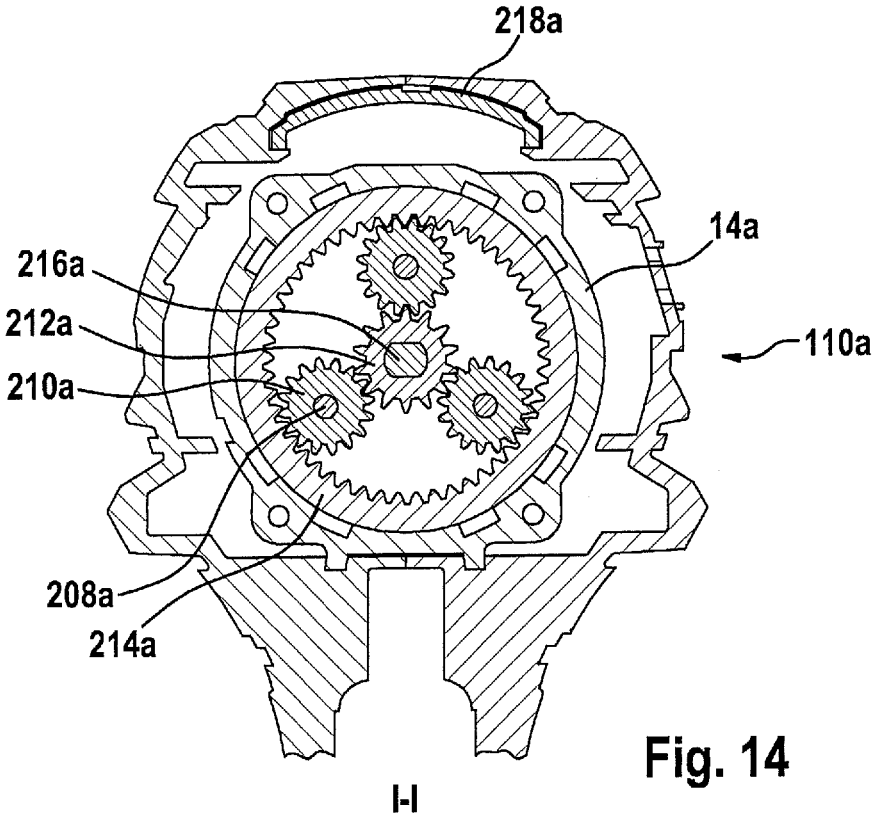
FIG. 14 shows a plane of section I of a fourth planetary gear stage of the handheld tool device of FIG. 1.

FIG. 14 shows a plane of section I of third planetary gear stage 108*a*. Sun gear 202*a* of third planetary gear stage 108*a* is connected to a planet carrier 208*a* of fourth planetary gear stage 110*a* in a rotationally rigid manner. Planet gears 210*a* of fourth planetary gear stage 110*a* mesh with a sun gear 212*a* and a ring gear 214*a* of fourth planetary gear stage 110*a*. Ring gear 214*a* is connected to handheld tool housing 14*a* in a rotationally rigid manner. Sun gear 212*a* of fourth planetary gear stage 110*a* is connected in a rotationally rigid manner to a rotor 216*a* of drive unit 30*a*.

Ring gear 204*a* of third planetary gear stage 108*a* is supported to be displaceable in the axial direction, as shown in FIG. 2. In the first gear ratio, ring gear 204*a* of third planetary gear stage 108*a* is connected to handheld tool housing 14*a* in a rotationally rigid manner. In the second gear ratio, ring gear 204*a* of third planetary gear stage 108*a* is connected to planet carrier 208*a* of fourth planetary gear stage 110*a* in a rotationally rigid manner and is supported to be rotatable relative to handheld tool housing 14*a*. This produces a reduction ratio of the first gear ratio between rotor 216*a* of drive unit 30*a* and planet carrier 198*a* of third planetary gear stage 108*a*, which reduction ratio is greater than a reduction ratio of the second gear ratio.

Operating device 32*a* has a first operating element 218*a* and a second operating element 220*a*. First operating element 218*a* is disposed on a side of handheld tool housing 14*a* remote from hand grip 18*a*. It is supported to be movable parallel to the axial direction of planetary gear 28*a*. First operating element 218*a* is connected to ring gear 204*a* of third planetary gear stage 108*a* in the axial direction via an adjusting element 222*a* of operating device 32*a*. Ring gear 204*a* of third planetary gear stage 108*a* has a keyway 224*a* with which adjusting element 222*a* engages. Accordingly, ring gear 204*a* of third planetary gear stage 108*a* is connected to adjusting element 222*a* in the axial direction in such a manner as to be axially rotatable relative to adjusting element 222*a*. Adjusting element 222*a* is constructed to be resilient, whereby the gear ratio may be adjusted independently of a rotational position of ring gear 204 of third planetary gear stage 108*a*. When first operating element 218*a* is pushed in the direction of tool chuck 36*a*, the first gear ratio is set. When second operating element 220*a* is pushed away from tool chuck 36*a*, the second gear ratio is set.

Second operating element 220*a* is disposed on a side of handheld tool housing 14*a* remote from hand grip 18*a*. Second operating element 220*a* is disposed so as to be displaceable about an axis oriented parallel to the axial direction of planetary gear 28*a*. Second operating element 220*a* is connected to control element 134*a* of handheld tool device 12*a* in a rotationally rigid manner. With second operating element 220*a*, the screwing mode, the drilling mode and the hammer-drilling mode may be set. When second operating element 220*a* is pushed to the left as viewed in impact direction 54*a*, the hammer-drilling mode is set. When second operating element 220*a* is pushed to the right as viewed in impact direction 54*a*, the screwing mode is set. When second operating element 220*a* is situated centrally as viewed in impact direction 54*a*, the drilling mode is set.

Figure 15:
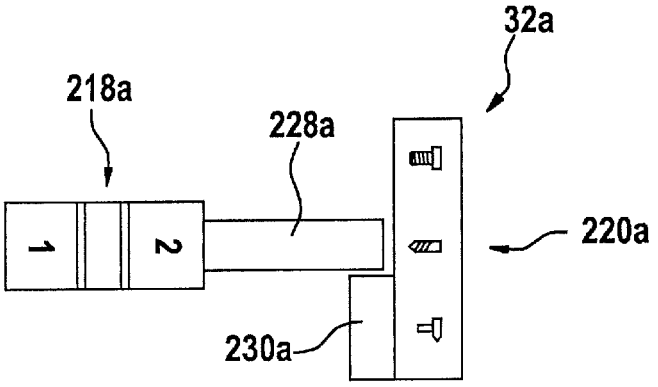
FIG. 15 shows a schematic representation of an operating device and a safety device of the handheld tool device of FIG. 1.

FIG. 15 shows schematically a safety device 226*a* of handheld tool device 12*a*, which, in the hammer-drilling mode, prevents operation in the first gear ratio. In FIG. 15, first gear ratio and drilling mode have been set. Safety device 226*a* is constructed partially in one piece with operating device 32*a*. A first inhibiting element 228*a* of safety device 226*a* is integrally formed on first operating element 218*a*. A second inhibiting element 230*a* of safety device 226*a* is integrally formed on second operating element 220*a*. Inhibiting elements 228*a* are each of a tongue-shaped configuration. First inhibiting element 228*a* extends in the direction of second operating element 220*a*. Second inhibiting element 230*a* extends in the direction of first operating element 218*a*. Safety device 226*a* prevents switching over into the hammer-drilling mode when the first gear ratio is set. Safety device 226*a* prevents switching over into the first gear ratio when the hammer-drilling mode is set.

Drive unit 30*a* is in the form of an electric motor. Drive unit 30*a* has a maximum torque which causes a maximum tool torque of more than 15 Nm in the first gear ratio and of less than 15 Nm in the second gear ratio. The maximum tool torque in the first gear ratio is 30 Nm. The maximum tool torque in the second gear ratio is 10 Nm. The tool torque is to be specified in this case in accordance with the DIN EN 60745 standard.

In a hammer-drilling mode, impact switch spring 148*a* of handheld tool device 12*a* opens impact deactivation coupling 142*a* when the operator removes the application tool from the workpiece. Impact switch spring 148*a* is disposed coaxially with planetary gear stages 104*a*, 106*a*, 108*a*, 110*a* of planetary gear 28*a*. Second planetary gear stage 106*a* and third planetary gear stage 108*a* each surround impact switch spring 148*a* on at least one plane that is oriented perpendicularly to the axial direction of planetary gear 28*a*. Second planetary gear stage 106*a* and third planetary gear stage 108*a* are each operatively disposed between at least two further planetary gear stages 104*a*, 106*a*, 108*a*, 110*a* of planetary gear 28*a*. Planet carrier 120*a* of second planetary gear stage 106*a* supports impact switch spring 148*a* on a side remote from tool chuck 36*a*.

In FIGS. 16 through 19, further exemplary embodiments of the present invention are shown. The following descriptions and the drawings are substantially restricted to the differences between the exemplary embodiments; with regard to components having identical names, especially with regard to components having identical reference characters, reference may also be made in principle to the drawings and/or the description of the other exemplary embodiments, especially FIGS. 1 through 15. To distinguish between the exemplary embodiments, the letter "a" is placed after the reference numerals of the exemplary embodiment in FIGS. 1 through 15. In the exemplary embodiments of FIGS. 16 through 19, the letter "a" is replaced by the letters "b" through "e".

Figure 16:
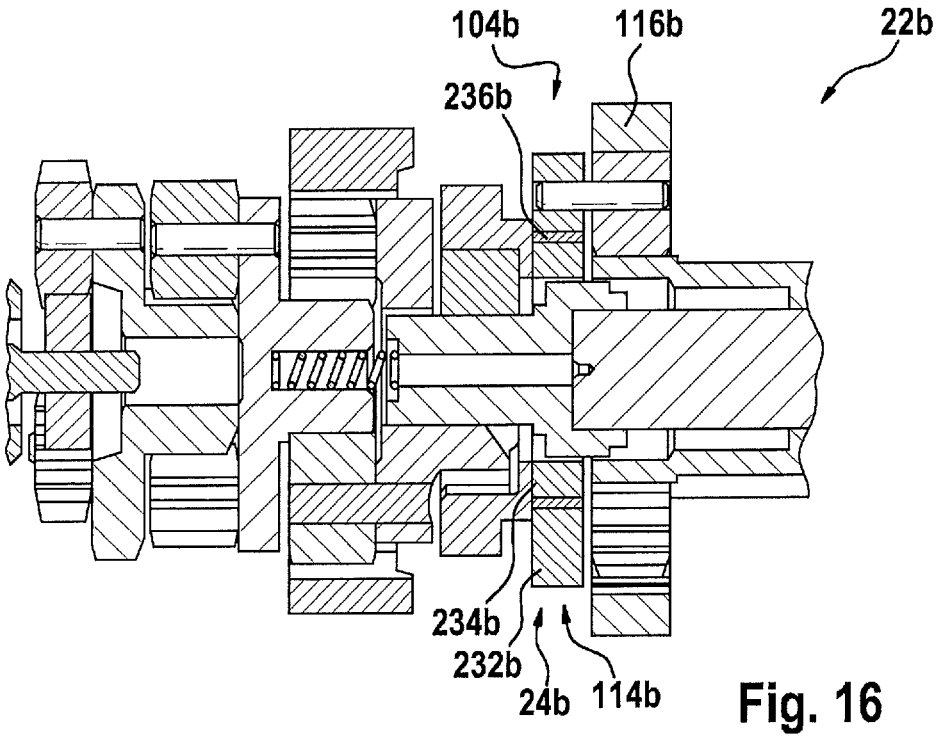
FIG. 16 shows an alternative exemplary embodiment of a first impact deactivation device of a handheld tool device according to the invention.

In FIG. 16, a further, alternative exemplary embodiment of first impact deactivation device 24*a* is shown schematically. A planet carrier 114*b* of a first planetary gear stage 104*b* is constructed in two parts. A first part 232*b* of planet carrier 114*b* guides planet gears 112*b* of first planetary gear stage 104*b*. A second part 234*b* of planet carrier 114*b* is rotationally coupled to a second planetary gear stage 106*b*. A first impact deactivation device 24*b* of a hammer mechanism 22*b* has a freewheel 236*b* considered suitable by one skilled in the art, which freewheel 236*b* connects first part 232*b* and second part 234*b* of planet carrier 114*b* in a rotationally rigid manner in the case of a clockwise drilling rotational direction and separates them in the case of an anticlockwise drilling rotational direction. A ring gear 116*b* of first planetary gear stage 104*b* is connected to a handheld tool housing in a permanently rotationally rigid manner.

Figure 17:
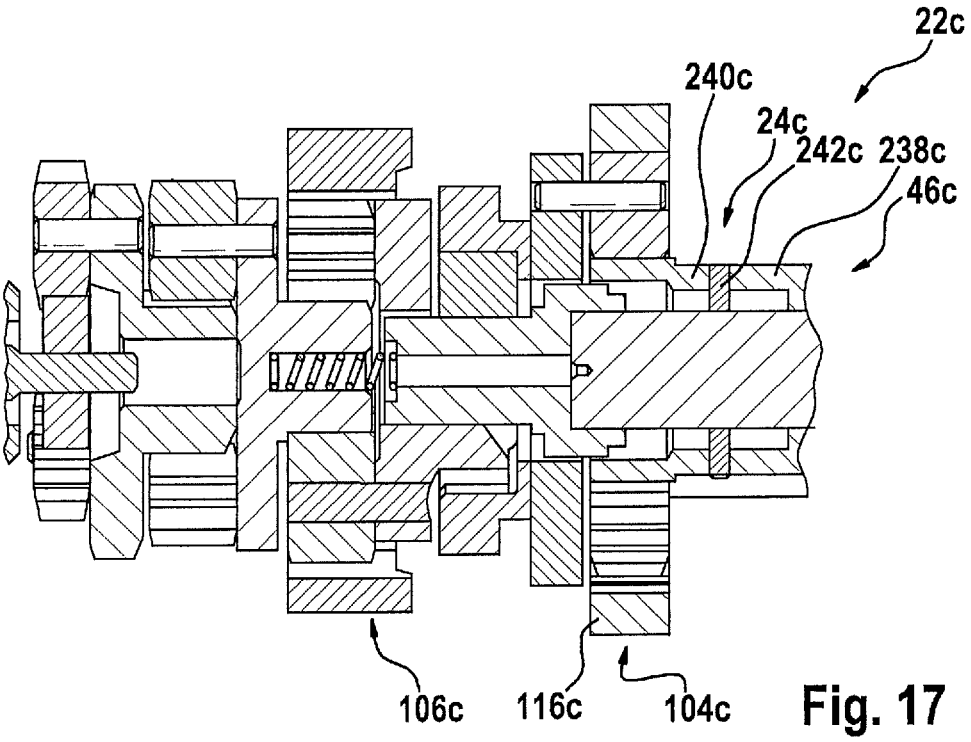
FIG. 17 shows a further exemplary embodiment of a first impact deactivation device of a handheld tool device according to the invention.

In FIG. 17, a next exemplary embodiment of a first impact deactivation device 24*c* is shown schematically. A hammer mechanism spindle 46*c* of a hammer mechanism 22*c* is constructed in two parts. A first part 238*c* of hammer mechanism spindle 46*c* is connected to a striker driving device. A second part 240*c* of hammer mechanism spindle 46*c* is connected to a second planetary gear stage 106*c*. First impact deactivation device 24*c* has a freewheel 242*c* considered suitable by one skilled in the art, which freewheel 242*c* connects first part 238*b* and second part 240*c* of hammer mechanism spindle 46*c* in a rotationally rigid manner in the case of a clockwise drilling rotational direction and separates them in the case of an anticlockwise drilling rotational direction. A ring gear 116*a* of first planetary gear stage 104*c* is connected to a handheld tool housing in a permanently rotationally rigid manner.

Figure 18:
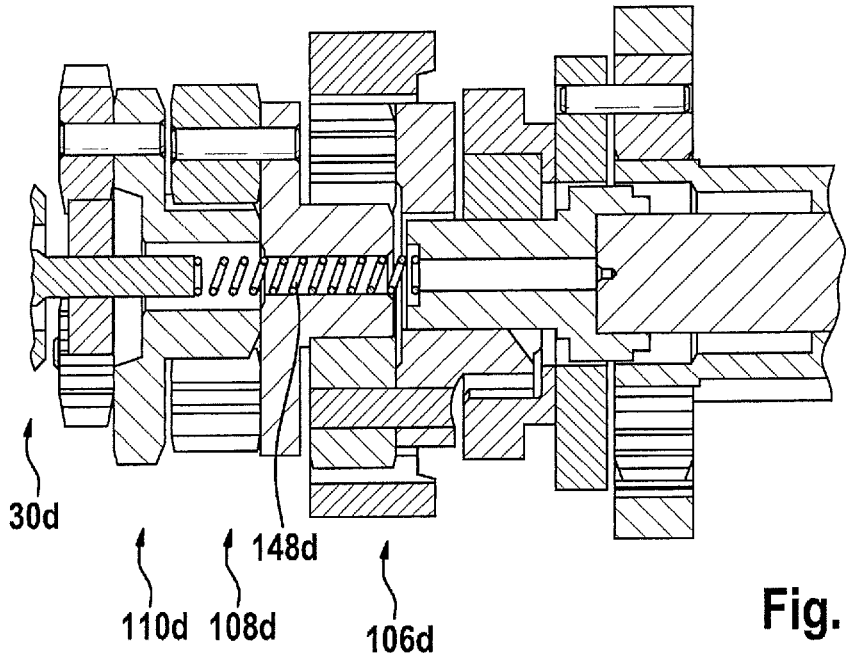
FIG. 18 shows an alternative exemplary embodiment of an impact switch spring of a handheld tool device according to the invention.

In FIG. 18, a further exemplary embodiment of an impact switch spring 148*d* is illustrated. A second planetary gear stage 106*d* supports impact switch spring 148*d* on a side toward a tool chuck. A drive unit 30*d* supports impact switch spring 148*d* on a side remote from a tool chuck. Second planetary gear stage 106*d*, a third planetary gear stage 108*d* and a fourth planetary gear stage 110*d* each surround impact switch spring 148*d* on at least one plane oriented perpendicularly to an axial direction of planetary gear stages 106*d*, 108*d*, 110*d*. Drive unit 30*d* is connected to a portion of planetary gear stage 110*d* in a rotationally rigid manner.

Figure 19:
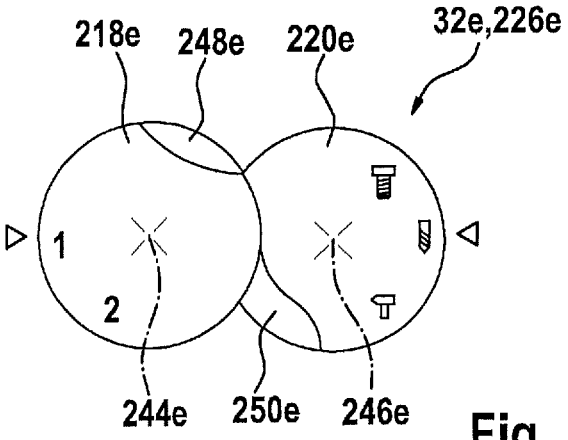
FIG. 19 shows an alternative exemplary embodiment of an operating device and a safety device of a handheld tool device according to the invention.

FIG. 19 shows an alternative exemplary embodiment of operating device 32*e* and of a safety device 226*e*. Operating device 32*e* has a first operating element 218*e* and a second operating element 220*e*. Operating elements 218*e*, 220*e* are supported so as to be pivotable about rotation axes 244*e*, 246*e*. Operating elements 218*e*, 220*e* have a disc-shaped basic shape. First operating element 218*e* is connected, in a manner not shown in detail, to a planetary gear by way of a mechanism considered suitable by one skilled in the art. With first operating element 218*e*, a first gear ratio and a second gear ratio may be set. Second operating element 220*e* is connected, in a manner not shown in detail, to a control element by way of a mechanism considered suitable by one skilled in the art. With second operating element 220*e*, a screwing mode, a drilling mode and a hammer-drilling mode may be set. Furthermore, a chisel mode could be set.

Safety device 226*e* has a free-running region 248*e* delimited by first operating element 218*e*. Safety device 226*e* has a free-running region 250*e* delimited by second operating element 220*e*. Free-running region 248*e* of first operating element 218*e* makes it possible to set the screwing mode, the drilling mode and the hammer-drilling mode when a second gear ratio is set. Free-running region 250*e* of second operating element 220*e* makes it possible to set the screwing mode and the drilling mode when a first gear ratio is set. In the hammer-drilling mode, safety device 226*e* prevents setting of the first gear ratio. When first gear ratio is set, safety device 226*e* prevents setting of the hammer-drilling mode.

What is claimed is:

1. A handheld tool device, comprising:

a hammer mechanism which includes a striker and at least one cam guide which drives the striker at least in a hammer-drilling mode, wherein the striker includes at least a portion of the cam guide and is supported to move axially to provide impacts in an axial impact direction, wherein the striker is fixed against rotation relative to a handheld tool housing during an impact operation such that the striker is rotationally immobile relative to the handheld tool housing during the impact operation, wherein the hammer mechanism includes a hammer mechanism spindle which includes at least a portion of the cam guide, wherein the striker at least substantially surrounds the hammer mechanism spindle on at least one plane by 360 degrees; and a tool spindle, wherein the striker surrounds the tool spindle on at least one plane by 360 degrees, wherein the tool spindle is disposed at least substantially coaxially with the hammer mechanism spindle, wherein the cam guide has an impact free-running region through which a connecting element moves, at least in a hammer-drilling mode, without experiencing an axial force, wherein the cam guide has an impact pull-up region which moves the striker, at least in a hammer-drilling mode, counter to the axial impact direction, wherein the impact pull-up region is of a helical configuration and extend through 180 degrees about a rotation axis of the hammer mechanism spindle.

2. The handheld tool device as recited in claim 1, wherein the cam guide has a mounting aperture.

3. The handheld tool device as recited in claim 1, wherein the hammer mechanism spindle has a guide cam of the cam guide.

4. The handheld tool device as recited in claim 1, wherein the hammer mechanism has a connecting element which in at least one operating state transmits a motion to the striker.

5. The handheld tool device as recited in claim 4, wherein the connecting element is embodied as a ball.

6. The handheld tool device as recited in claim 1, wherein the hammer mechanism has a striker guide which supports the striker in a manner fixed against relative rotation.

7. The handheld tool device as recited in claim 1, wherein the hammer mechanism has a hammer mechanism spring which is supported on the striker and on the handheld tool housing.

8. The handheld tool device as recited in claim 1, wherein the hammer mechanism includes a first cam guide and a second cam guide.

9. The handheld tool device as recited in claim 8, wherein the first cam guide and the second cam guide are disposed offset by 180 degrees about the rotation axis.

10. The handheld tool device as recited in claim 8, wherein the first cam guide and the second cam guide are disposed one behind the other in the axial impact direction.

11. The handheld tool device as recited in claim 1, wherein the impact free-running region connects two ends of the helical impact pull-up region and extends through 180 degrees about the rotation axis of the hammer mechanism spindle.

12. A handheld tool, comprising:

a handheld tool device, comprising:

a hammer mechanism which includes a striker and at least one cam guide which drives the striker at least in a hammer-drilling mode, wherein the striker includes at least a portion of the cam guide and is supported to move axially to provide impacts in an axial impact direction, wherein the striker is fixed against rotation relative to a handheld tool housing during an impact operation such that the striker is rotationally immobile relative to the handheld tool housing during the impact operation, wherein the hammer mechanism includes a hammer mechanism spindle which includes at least a portion of the cam guide, wherein the striker at least substantially surrounds the hammer mechanism spindle on at least one plane by 360 degrees; and a tool spindle, wherein the striker surrounds the tool spindle on at least one plane by 360 degrees, wherein the tool spindle is disposed at least substantially coaxially with the hammer mechanism spindle, wherein the cam guide has an impact free-running region through which a connecting element moves, at least in a hammer-drilling mode, without experiencing an axial force, wherein the cam guide has an impact pull-up region which moves the striker, at least in a hammer-drilling mode, counter to the axial impact direction, wherein the impact pull-up region is of a helical configuration and extend through 180 degrees about a rotation axis of the hammer mechanism spindle.

* * * * *